US006213304B1

(12) United States Patent
Juliussen

(10) Patent No.: US 6,213,304 B1
(45) Date of Patent: Apr. 10, 2001

(54) INFANT CARE TOTE BAG

(76) Inventor: Tara Juliussen, 98 Stayton Road, Sutton, Surrey SM1 2PU (GB)

( * ) Notice: Subject to any disclaimer, the term of this patent is extended or adjusted under 35 U.S.C. 154(b) by 0 days.

(21) Appl. No.: 09/466,075

(22) Filed: Dec. 17, 1999

(51) Int. Cl.[7] ..... B65D 69/00
(52) U.S. Cl. ..... 206/581; 224/614; 224/610
(58) Field of Search ..... 206/223, 440, 206/570, 581; 224/257, 600, 601, 607, 610, 611, 614; 190/102, 117

(56) References Cited

U.S. PATENT DOCUMENTS

D. 289,106 4/1987 Leiserson .
2,326,452 8/1943 Freedland .
3,696,850 10/1972 Rosenblum .
4,961,522 10/1990 Weber .
5,062,557 11/1991 Mahvi et al. .
5,725,382 * 3/1998 Walter et al. ..... 206/581
5,743,649 4/1998 Gonzalez .
6,021,937 * 2/2000 Schryver et al. ..... 224/611
6,126,012 * 10/2000 Roegner ..... 206/579

* cited by examiner

*Primary Examiner*—David T. Fidei

(57) ABSTRACT

A infant care tote bag for holding infant care supplies therein. The infant care tote bag includes a pair of body portions pivotally coupled together. An elongate shoulder strap is provided having a pair of opposite V-shaped ends which are detachably attached to the body portions.

8 Claims, 3 Drawing Sheets

INFANT CARE TOTE BAG

BACKGROUND OF THE INVENTION

1. Field of the Invention

The present invention relates to luggage for holding infant care supplies and more particularly pertains to a new infant care tote bag for holding infant care supplies therein.

2. Description of the Prior Art

The use of luggage for holding infant care supplies is known in the prior art. More specifically, luggage for holding infant care supplies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 5,062,557; U.S. Pat. No. 4,961,522; U.S. Pat. No. 3,696,850; U.S. Pat. No. 5,743,649; U.S. Pat. No. 2,326,452; and U.S. Pat. No. Des. 289,106.

While these devices fulfill their respective, particular objectives and requirements, the aforementioned patents do not disclose a new infant care tote bag. The inventive device includes a pair of body portions pivotally coupled together. An elongate shoulder strap is provided having a pair of opposite V-shaped ends which are detachably attached to the body portions.

In these respects, the infant care tote bag according to the present invention substantially departs from the conventional concepts and designs of the prior art, and in so doing provides an apparatus primarily developed for the purpose of holding infant care supplies therein.

SUMMARY OF THE INVENTION

In view of the foregoing disadvantages inherent in the known types of luggage for holding infant care supplies now present in the prior art, the present invention provides a new infant care tote bag construction wherein the same can be utilized for holding infant care supplies therein.

The general purpose of the present invention, which will be described subsequently in greater detail, is to provide a new infant care tote bag apparatus and method which has many of the advantages of the luggage for holding infant care supplies mentioned heretofore and many novel features that result in a new infant care tote bag which is not anticipated, rendered obvious, suggested, or even implied by any of the prior art luggage for holding infant care supplies, either alone or in any combination thereof.

To attain this, the present invention generally comprises a pair of body portions pivotally coupled together. An elongate shoulder strap is provided having a pair of opposite V-shaped ends which are detachably attached to the body portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new infant care tote bag apparatus and method which has many of the advantages of the luggage for holding infant care supplies mentioned heretofore and many novel features that result in a new infant care tote bag which is not anticipated, rendered obvious, suggested, or even implied by any of the prior art luggage for holding infant care supplies, either alone or in any combination thereof.

It is another object of the present invention to provide a new infant care tote bag which may be easily and efficiently manufactured and marketed.

It is a further object of the present invention to provide a new infant care tote bag which is of a durable and reliable construction.

An even further object of the present invention is to provide a new infant care tote bag which is susceptible of a low cost of manufacture with regard to both materials and labor, and which accordingly is then susceptible of low prices of sale to the consuming public, thereby making such infant care tote bag economically available to the buying public.

Still yet another object of the present invention is to provide a new infant care tote bag which provides in the apparatuses and methods of the prior art some of the advantages thereof, while simultaneously overcoming some of the disadvantages normally associated therewith.

Still another object of the present invention is to provide a new infant care tote bag for holding infant care supplies therein.

Yet another object of the present invention is to provide a new infant care tote bag which includes a pair of body portions pivotally coupled together. An elongate shoulder strap is provided having a pair of opposite V-shaped ends which are detachably attached to the body portions.

Still yet another object of the present invention is to provide a new infant care tote bag that keeps wet and dry infant supplies separate.

Even still another object of the present invention is to provide a new infant care tote bag that is preferably insulated to keep foodstuffs held therein either cool or warm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
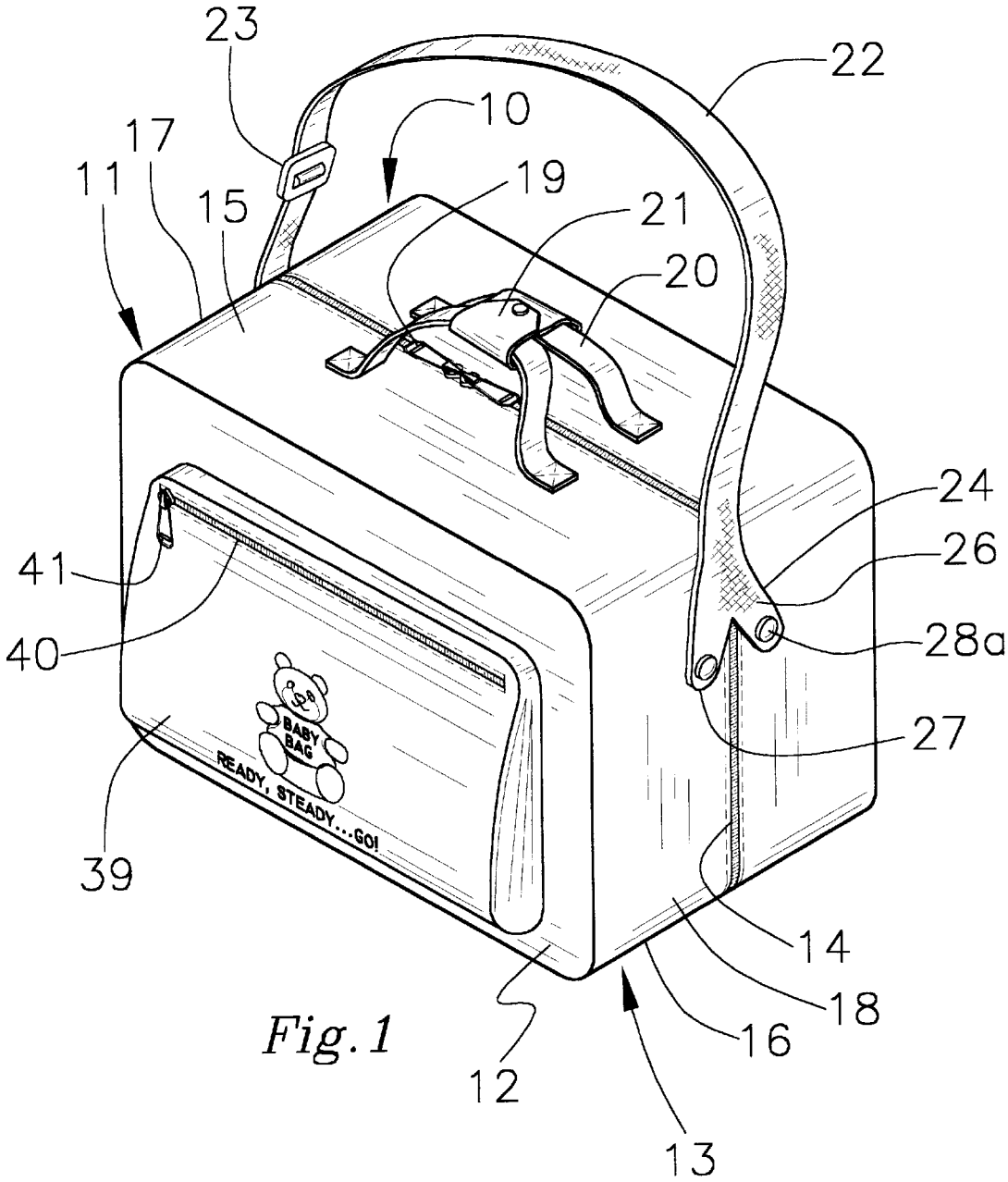
FIG. 1 is a schematic front perspective view of a new infant care tote bag in a closed position according to the present invention.

With reference now to the drawings, and in particular to FIGS. 1 through 4 thereof, a new infant care tote bag embodying the principles and concepts of the present invention will be described.

As best illustrated in FIGS. 1 through 4, the infant care tote bag generally comprises a pair of body portions pivotally coupled together. An elongate shoulder strap is provided having a pair of opposite V-shaped ends which are detachably attached to the body portions.

In closer detail, the tote bag comprises an exterior body comprising a pair of body portions 10,11 each defining a compartment and each having a generally rectangular face panel 12, and a perimeter wall 13 extending around an outer perimeter of the face panel of the respective body portion. The perimeter wall of each body portion has a free edge 14 and comprises top and bottom portions 15,16, and a pair of opposite end portions 17,18 extending between the top and bottom portions of the respective perimeter wall. The free edge of the perimeter wall of each body portion defines an opening into the compartment of the respective body portion.

Figure 4:
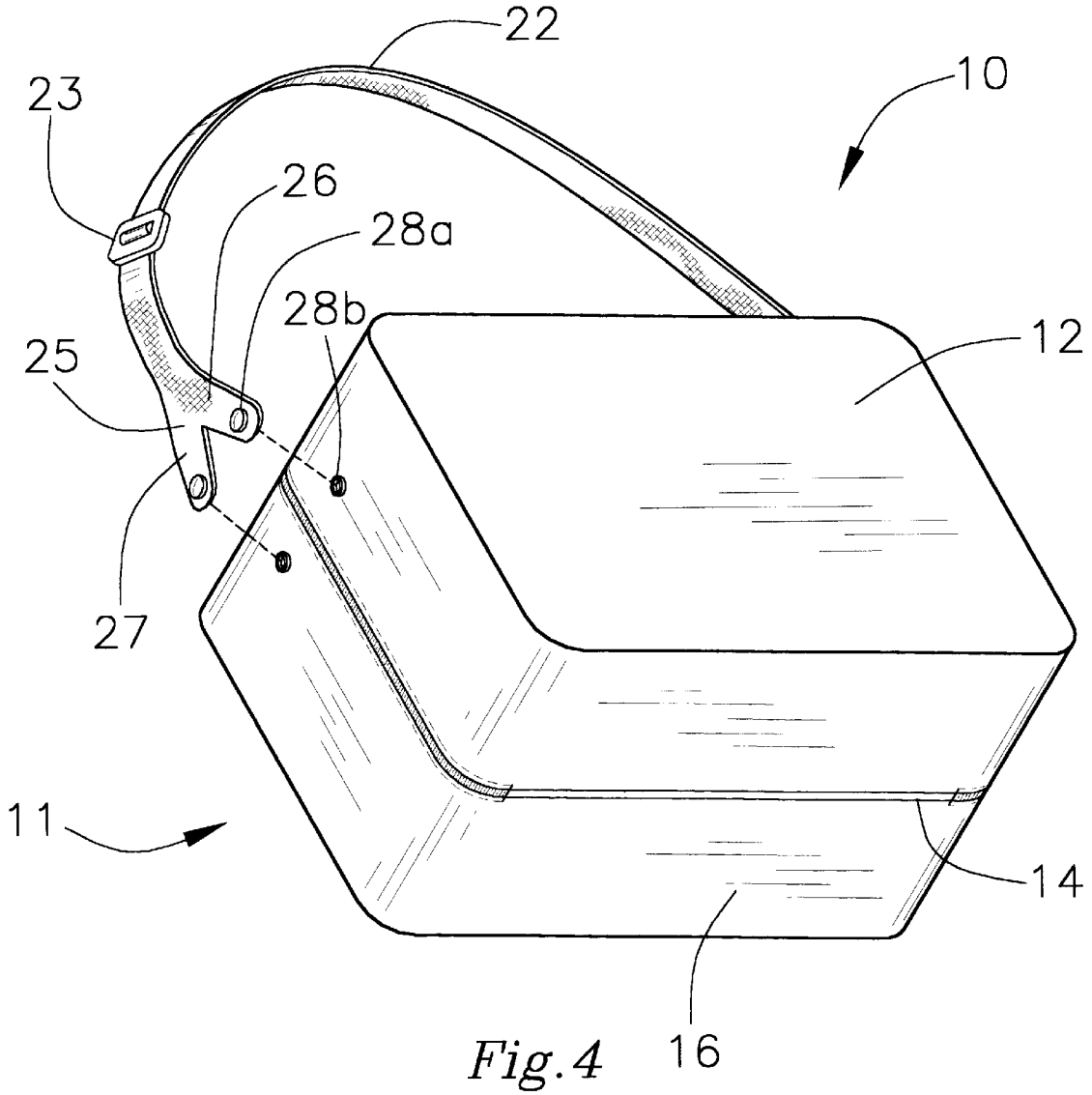
FIG. 4 is a schematic bottom perspective view of the present invention in the closed position.

The free edges of the body portions are pivotally coupled together along the bottom portions of the perimeter walls of the body portions to permit pivoting of the body portions between open and closed positions. With reference to FIGS. 1 and 4, the free edges of the body portions are positioned adjacent one another such that the openings of the body portions face one another when the body portions are positioned in the closed position. In the closed position, the top portions of the perimeter walls generally lie in a common plane with one another, the bottom portions of the perimeter walls generally lie in a common plane with one another, a first of the end portions of each perimeter wall generally lie in a common plane with one another, and a second of the end portions of each perimeter wall generally lie in a common plane with one another.

Figure 2:
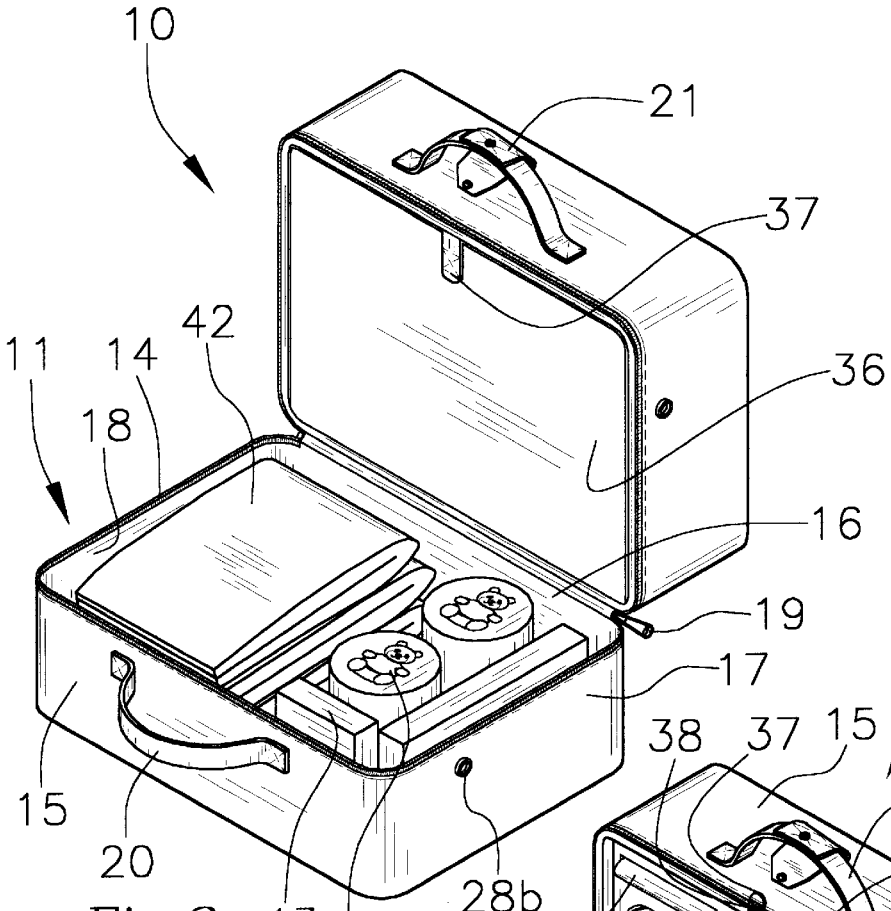
FIG. 2 is a schematic perspective view of the present invention in an open position revealing the compartment of the second body portion.
Figure 3:
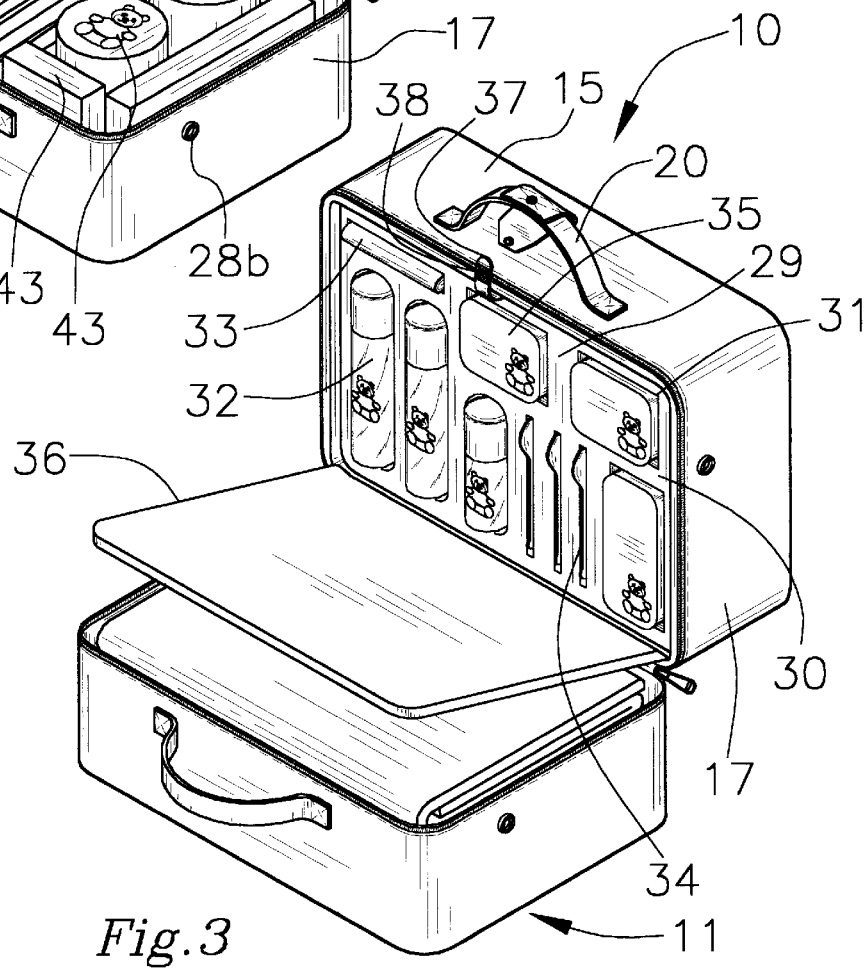
FIG. 3 is a schematic perspective view of the present invention in the open position with the divider panel pivoted downwards to reveal the insert.

With reference to FIGS. 2 and 3, the openings of the body portions are spaced apart from one another when the body portions are positioned in the open position to permit user access into the compartments of the body portions.

The exterior body has at least one zipper fastener 19 extending along the free edges of the perimeter walls to detachably attach the body portions together.

The top portions of the perimeter walls of the body portions each have a preferably flexible carry handle 20 coupled thereto. Ideally, a connecting strap 21 is wrapped around the carrying handles and coupled to one of the carrying handles for providing more comfort to a user's hand when carrying the tote bag with the carry handles.

An elongate shoulder strap 22 with an adjustable length buckle 23 has a pair of opposite ends 24,25 detachably attached to the body portions when the body portions are positioned in the closed position. As best illustrated in FIGS. 1 and 4, each of the ends of the of the shoulder strap is generally V-shaped and has a pair of arms 26,27. When the body portions are positioned in the closed position, a first of the arms of a first of the ends 24 of the shoulder strap is coupled to the first end portion of a first of the body portions 10 and a second of the arms of the first end of the shoulder strap is coupled to the first end portion of a second of the body portions 11. Similarly, a first of the arms of a second of the ends 25 of the shoulder strap is coupled to the second end portion of the first body portion and a second of the arms of the second end of the shoulder strap is coupled to the second end portion of a second of the body portions when the body portions are positioned in the closed position. Preferably, the arms are detachably coupled to the associated end portions of the body portions. Ideally, snap fasteners 28*a*, 28*b* detachably couple each arm to the associated end portion of the body portions.

With reference to FIG. 3, a generally rectangular block-shaped insert 29 is disposed in the compartment of a first of the body portions. The insert preferably comprises resiliently deformable material, and ideally, a foamed material. The insert has a generally rectangular exposed face 30 facing in an outwardly direction from the opening defined by the free edge of the perimeter wall of the first body portion. The exposed face of the insert has a plurality various shaped receptacles 31 therein each designed for holding infant supplies.

In an ideal embodiment, at least one baby bottle 32 for holding liquid sustenance therein is inserted into at least one of the receptacles of the insert. A baby bib or a container of baby wipes 33 is inserted into one of the receptacles of the insert. At least one feeding utensil 34 such as a spoon is inserted into at least one of the receptacles of the insert. At least one food container 35 for holding baby food therein is inserted into at least one of the receptacles of the insert.

Preferably, the first body portion also has a generally rectangular dividing panel 36 substantially covering the exposed face of the insert and is pivotally coupled to the bottom portion of the perimeter wall of the first body portion adjacent the free edge of the perimeter wall of the first body portion. A flexible holding strap 37 is extended from the top portion of the perimeter wall of the first body portion into the compartment of the first body portion. Ideally, the holding strap is detachably attached to the divider panel preferably by a hook and loop fastener 38. In use, the divider panel is designed for preventing the items inserted into the receptacles of the insert from falling out.

Ideally, the divider panel comprises an insulating material for resisting the passage of heat therethrough to help maintain a constant temperature for the food and liquid items. In this ideal embodiment, the face panel and perimeter wall of the first body portion also preferably comprise an insulating material to resist passage of heat therethrough.

Preferably, an expandable pouch 39 for holding items therein is coupled to the face panel of a second of the body portions. The pouch has a 40 slit providing an opening into the pouch and a zipper fastener 41 along the slit for closing the opening into the pouch.

In an ideal embodiment, at least one diaper 42, and at least one storage container 43 is disposed in the compartment of the second body portion.

In an ideal illustrative embodiment, the tote bag has a length of about 14 inches, a height of about 10 inches, and a depth of about 8½ inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tote bag, comprising:

a pair of body portions each defining a compartment and each having a face panel, a perimeter wall extending around an outer perimeter of said face panel of the respective body portion;

said perimeter wall of each body portion having top and bottom portions, and a pair of opposite end portions extending between said top and bottom portions of said respective perimeter wall;

said bottom portions of said perimeter walls of said body portions being pivotally coupled together;

said top portions of said perimeter walls of said body portions each having a flexible carry handle coupled thereto;

an elongate shoulder strap having a pair of opposite ends, each of said ends of said of said shoulder strap being generally V-shaped and having a pair of arms;

a first of said arms of a first of said ends of said shoulder strap being coupled to said first end portion of a first of said body portions when said body portions are positioned in said closed position;

a second of said arms of a first of said ends of said shoulder strap being coupled to said first end portion of a second of said body portions when said body portions are positioned in said closed position;

a first of said arms of a second of said ends of said shoulder strap being coupled to said second end portion of a first of said body portions when said body portions are positioned in said closed position; and a second of said arms of a second of said ends of said shoulder strap being coupled to said second end portion of a second of said body portions when said body portions are positioned in said closed position.

2. The tote bag of claim 1, further comprising a connecting strap being wrapped around said carrying handles and coupled to one of said carrying handles.

3. The tote bag of claim 1, wherein said arms are detachably coupled to the associated end portions of said body portions.

4. The tote bag of claim 3, wherein snap fasteners detachably coupled each arm to the associated end portion of said body portions.

5. The tote bag of claim 1, further comprising an insert being disposed in said compartment of a first of said body portions, wherein said insert has an exposed face having a plurality receptacles therein.

6. The tote bag of claim 5, wherein said insert comprises a resiliently deformable material.

7. The tote bag of claim 5, wherein said first body portion has a dividing panel substantially covering said exposed face of said insert and being pivotally coupled to said bottom portion of said perimeter wall of said first body portion.

8. A tote bag, comprising:

a pair of body portions each defining a compartment and each having a generally rectangular face panel, a perimeter wall extending around an outer perimeter of said face panel of the respective body portion;

said perimeter wall of each body portion having a free edge and comprising top and bottom portions, and a pair of opposite end portions extending between said top and bottom portions of said respective perimeter wall;

said free edge of said perimeter wall of each body portion defining an opening into the compartment of the respective body portion;

said free edges of said body portions being pivotally coupled together along said bottom portions of said perimeter walls of said body portions to permit pivoting of said body portions between open and closed positions;

said free edges of said body portions being positioned adjacent one another such that said openings of said body portions face one another when said body portions are positioned in said closed position;

said top portions of said perimeter walls generally lying in a common plane with one another when said body portions are positioned in said closed position, said bottom portions of said perimeter walls generally lying in a common plane with one another when said body portions are positioned in said closed position, and a first of said end portions of each perimeter wall generally lying in a common plane with one another and a second of said end portions of each perimeter wall generally lying in a common plane with one another when said body portions are positioned in said closed position;

said openings of said body portions being spaced apart from one another when said body portions are positioned in said open position;

a zipper fastener extending along said free edges of said perimeter walls to detachably attach said body portions together;

said top portions of said perimeter walls of said body portions each having a flexible carry handle coupled thereto, a connecting strap being wrapped around said carrying handles and coupled to one of said carrying handles;

an elongate shoulder strap having a pair of opposite ends; each of said ends of said of said shoulder strap being generally V-shaped and having a pair of arms;

a first of said arms of a first of said ends of said shoulder strap being coupled to said first end portion of a first of said body portions when said body portions are positioned in said closed position;

a second of said arms of a first of said ends of said shoulder strap being coupled to said first end portion of a second of said body portions when said body portions are positioned in said closed position;

a first of said arms of a second of said ends of said shoulder strap being coupled to said second end portion of a first of said body portions when said body portions are positioned in said closed position;

a second of said arms of a second of said ends of said shoulder strap being coupled to said second end portion of a second of said body portions when said body portions are positioned in said closed position;

wherein said arms are detachably coupled to the associated end portions of said body portions, wherein snap fasteners detachably coupled each arm to the associated end portion of said body portions;

an insert being disposed in said compartment of a first of said body portions, said insert comprising resiliently deformable material;

said insert having a generally rectangular exposed face facing in an outwardly direction from said opening defined by said free edge of said perimeter wall of said first body portion;

said exposed face of said insert having a plurality receptacles therein;

at least one baby bottle being inserted into at least one of said receptacles of said insert;

a baby bib being inserted into one of said receptacles of said insert;

at least one feeding utensil being inserted into at least one of said receptacles of said insert;

at least one food container being inserted into at least one of said receptacles of said insert;

said first body portion having a generally rectangular dividing panel substantially covering said exposed face of said insert and being pivotally coupled to said bottom portion of said perimeter wall of said first body portion adjacent said free edge of said perimeter wall of said first body portion;

a pouch being coupled to said face panel of a second of said body portions, said pouch having a slit providing an opening into said pouch and a zipper fastener along said slit for closing said opening into said pouch; and at least one diaper, and at least one storage container being disposed in said compartment of said second body portion.

* * * * *